US007232113B2

(12) United States Patent
Heinrichs et al.

(10) Patent No.: US 7,232,113 B2
(45) Date of Patent: Jun. 19, 2007

(54) DRAW WORKS

(75) Inventors: Peter Heinrichs, Wegberg (DE); Albrecht Heinrichs, Ratingen (DE)

(73) Assignee: Wirth Maschinen- und Bohrgeräte-Fabrik GmbH, Erkelenz (DE)

( * ) Notice: Subject to any disclaimer, the term of this patent is extended or adjusted under 35 U.S.C. 154(b) by 349 days.

(21) Appl. No.: 10/506,032

(22) PCT Filed: Feb. 19, 2003

(86) PCT No.: PCT/EP03/01665

§ 371 (c)(1),
(2), (4) Date: Aug. 26, 2004

(87) PCT Pub. No.: WO03/072904

PCT Pub. Date: Sep. 4, 2003

(65) Prior Publication Data

US 2005/0133773 A1 Jun. 23, 2005

(30) Foreign Application Priority Data

Feb. 27, 2002 (DE) ..... 102 08 370

(51) Int. Cl.
*B66D 1/14* (2006.01)

(52) U.S. Cl. ..... 254/342; 254/379

(58) Field of Classification Search ..... 254/342, 254/377–379

See application file for complete search history.

(56) References Cited

U.S. PATENT DOCUMENTS

| | | | | |
|---|---|---|---|---|
| 3,981,485 | A * | 9/1976 | Eddy et al. | 254/340 |
| 4,069,921 | A * | 1/1978 | Raugulis et al. | 254/337 |
| 4,337,926 | A * | 7/1982 | Dehaan | 254/365 |
| 4,434,971 | A * | 3/1984 | Cordrey | 254/273 |
| 4,696,377 | A | 9/1987 | Richardson et al. | |
| 4,746,100 | A * | 5/1988 | Davenport et al. | 254/379 |
| 5,342,020 | A * | 8/1994 | Stone | 254/269 |
| 5,425,435 | A * | 6/1995 | Gregory | 188/77 W |

FOREIGN PATENT DOCUMENTS

| | | |
|---|---|---|
| DE | 1137277 | 1/1961 |
| EP | 0708226 | 4/1996 |
| GB | 842435 | 10/1957 |
| WO | 0164573 | 9/2001 |

* cited by examiner

*Primary Examiner*—Emmanuel M Marcelo
(74) *Attorney, Agent, or Firm*—Friedrich Kueffner

(57) ABSTRACT

In the drawworks for lowering and withdrawing a load, in particular a drilling or a drilling plugging device, in particular for use on floating drilling platforms, which drawworks has at least one brake arrangement for braking and holding the load, an emergency brake device is provided for producing an additional braking force.

14 Claims, 6 Drawing Sheets

DRAW WORKS

The invention relates to a drawworks for lowering and withdrawing a load.

Such drawworks serve to lower and withdraw a load, in particular a drilling device or a borehole plugging device, for example from a floating platform onto the sea bottom or into or onto a borehole. They have a rotatably mounted winding drum, to which a flexible draw means is fastened, which is usually designed as steel cable and can be wound up or unwound by rotary drive of the winding drum.

At least one rotary drive device is provided for the rotary drive of the drum. This rotary drive device regularly comprises an electric motor. However, it is likewise possible to use a hydraulic or pneumatic drive instead of a direct-current motor.

To brake the winding drum during the lowering of the load and to hold the load above the bottom, such drawworks have a brake device which comprises a mechanically acting brake arrangement. To relieve this mechanically acting brake arrangement, further brake arrangements which do not act mechanically, for example eddy-current brake arrangements, may also be provided.

In practice, the drawworks are adapted in their construction to the maximum hoisting capacity to be expected, which is determined by the intended use of the drawworks. Said hoisting capacity, by definition, is specified for the first cable layer on the winding drum. For further winding layers, i.e. during further winding-up of the cable onto the winding drum, the maximum hoisting capacity decreases due to the larger lever associated therewith, under which the load acts on the winding drum.

For safety, the cable is dimensioned in such a way that its breaking load corresponds to at least twice the hoisting load of the drawworks. The superstructures via which the cable is deflected—for example a mast—are designed for 1.8 times the hoisting load. In order to avoid a situation, caused by actuation of the brake device, in which forces can be exerted on the superstructures or the cable which are greater than the breaking load of these components, the brake device is conceived in such a way that the maximum load to be held corresponds to 1.5 to 1.6 times the hoisting load.

In the past, incidents have repeatedly occurred in which an unwinding operation could not be stopped or could not be stopped in good time by means of the brake device. A possible cause for a series of such incidents could have been that loads were held above the bottom close to the maximum hoisting load with multiple cable layer on the winding drum, which has finally led to overloading of the brake device.

The object of the invention is therefore to improve the operational safety of such drawworks.

Owing to the fact that, according to the invention, an emergency brake device is provided for producing an additional braking force, the brake devices used hitherto, which—as described above—offer protection against overloading of other components and ensure trouble-free operation in the vast majority of applications, can continue to be used. The additional emergency brake device now enables an additional braking force to be applied if required, i.e. if the braking power is momentarily inadequate. Since the emergency brake devices are devices which are provided in addition to the brake device, and the latter is not simply dimensioned to be larger, the emergency brake devices are only activated when they are actually required. Braking of the winding drum is therefore even possible in the event of a total failure of the brake device.

In a first preferred embodiment of the drawworks according to the invention, the brake arrangement has at least one brake shoe acting on a rotary part and a device for applying a braking force to the at least one brake shoe, the emergency brake arrangement being designed in such a way that an additional device for optionally exerting an additional braking force on the rotary part is provided. If the braking power which can be achieved with the brake arrangement in normal operation is no longer sufficient, additional braking power can be actively produced by actuating the additional device.

The device for applying a braking force to the at least one brake shoe preferably comprises a spring arrangement applying the braking force to the at least one brake shoe. To control the braking force exerted on the brake shoe, the device comprises an arrangement which acts in the opposite direction to the spring arrangement and is intended for controlling the braking force exerted on the brake shoe. This measure ensures that, if the hydraulic device fails, the brake shoes are pressed against the brake disk with the maximum force, so that the maximum braking power is produced.

The additional device is then preferably designed in such a way that it comprises an arrangement for displacing the seat absorbing the reaction forces of the spring arrangement. When the additional device is actuated, the preloading of the spring arrangement is therefore increased, which leads to an increase in the braking force acting on the at least one brake shoe and thus to an increase in the braking power.

The additional device is preferably designed as a device which can be actuated hydraulically.

In a further preferred embodiment of the drawworks according to the invention, the emergency brake arrangement comprises an additional brake device which can be engaged alternatively to the brake arrangement.

If the brake arrangement and emergency brake arrangement are designed in such a way that in each case at least one hundred percent of the maximum braking power required can be achieved with them, the emergency brake arrangement can completely replace the brake arrangement, so that emergency operation of the drawworks is possible even in the event of complete failure of the brake arrangement.

The construction of the emergency brake arrangement can at least essentially correspond to that of the main brake arrangement.

If the drawworks comprises at least one gearbox coupled on the input side to a drive motor and interacting on the output side with a summation gear, it is possible to arrange the emergency brake arrangement on the input side and/or on the output side of the gearbox.

The emergency brake arrangement can be engaged manually.

Especially preferred, however, is an embodiment in which a control device is provided which compares the respective braking-power setpoint with a parameter characteristic of the braking-power actual value achieved by the main brake arrangement and, in the event of a differential value of braking setpoint—braking actual value >0, activates the emergency brake device so that the differential value corresponds approximately to 0, the maximum total braking power preferably being $\leqq 130\%$ of the braking-power setpoint. In this especially preferred embodiment, if the braking power achieved with the main brake arrangement decreases below the setpoint, the emergency brake arrangement is activated via the control device for producing the additional braking power required. Limiting the total braking power to a maximum of 130% of the setpoint avoids a situation in which forces exerted on the components of the drawworks or on other components by initiating the braking power reach values above the breaking loads of these components, thereby avoiding the risk of damage due to the initiation of excessive braking power.

In a further embodiment of the drawworks according to the invention, the emergency braking arrangement is formed by a feeding device for the controlled or regulated lowering, holding or withdrawal of the load, to be precise by virtue of the fact that the lowering device has a capacity suitable for braking and holding the maximum hoisting capacity of the drawworks.

The feeding device preferably comprises an electrically, hydraulically or pneumatically driven motor, which also serves to apply the emergency braking power. Furthermore, if the feeding device comprises a gearbox, to which the motor is coupled, the motor can be coupled to the gearbox via an additional gear shaft. However, it is likewise possible to couple the motor to the input shaft of the gearbox for a main drive motor for the drawworks.

Exemplary embodiments of the invention are shown in the drawing, in which.

Figure 1:
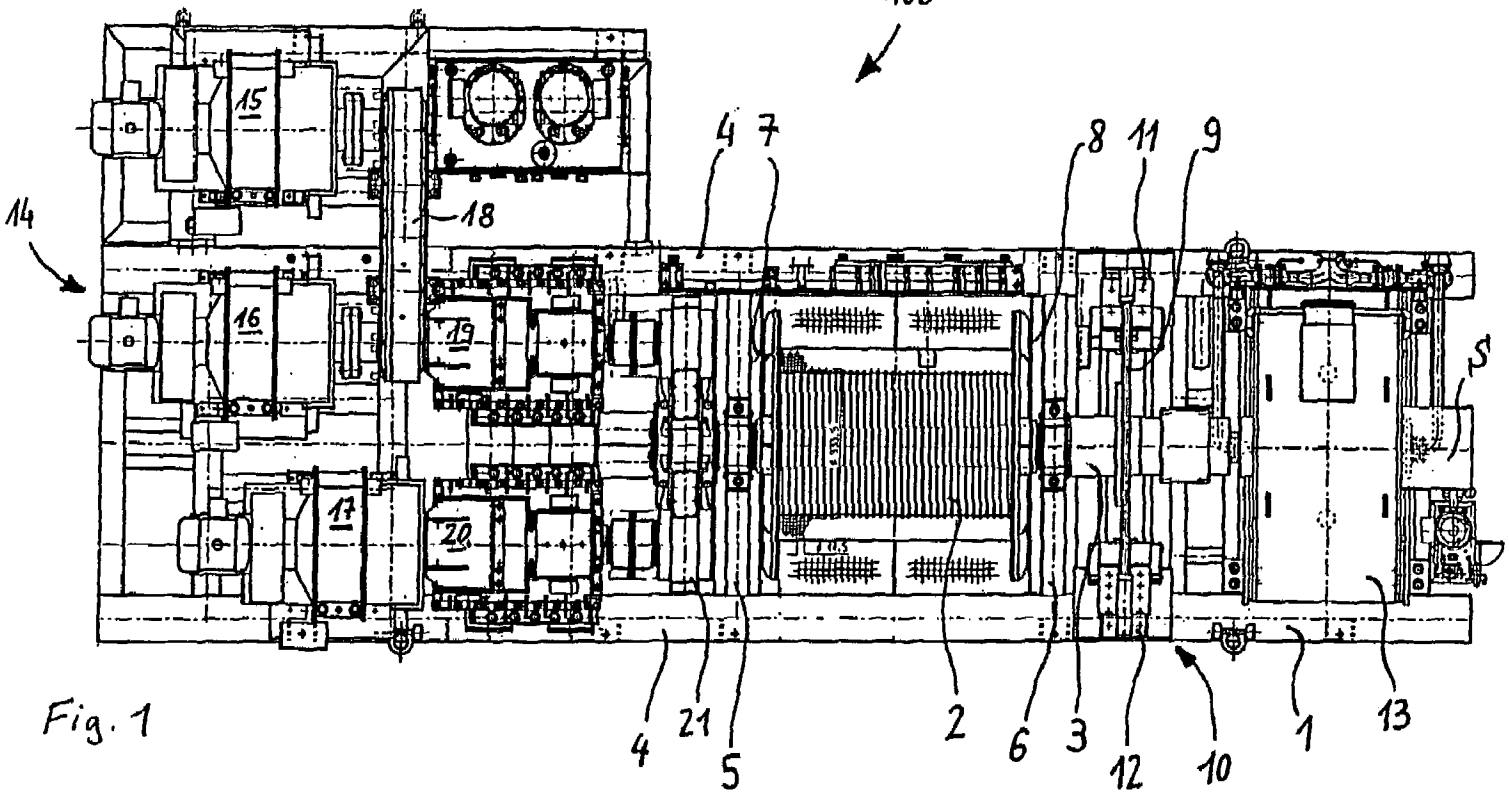
FIG. 1 shows a first embodiment of a drawworks according to the invention in a plan view.

The drawworks designated overall by 100 in FIG. 1 comprises a frame 1, on which the components of the drawworks are mounted. For withdrawing and lowering and also for holding a load, in particular a drilling implement or the like, the drawworks 100 comprises a drum 2 which is fastened to a drum shaft 3 in a rotationally fixed manner and the axis S of which runs parallel to the longitudinal sides 4 of the frame 1. It is mounted in bearing blocks 5, 6 which are arranged beyond the two end faces 7, 8 of the drum 2.

A brake disk 9 is arranged in a rotationally fixed manner on that region of the drum shaft 3 which is located on the right of the drum 2 in FIG. 1, this brake disk 9 being part of a brake arrangement which is designated overall by 10 and furthermore comprises two brake caliper arrangements 11, 12 offset by 180° in the direction of rotation of the axis S. A further brake caliper arrangement is concealed by the drum shaft 3 and is thus arranged in such a way that it cannot be seen in FIG. 1. By means of the brake arrangement 10, the drum 2 can be braked in its rotary speed or even completely stopped during the unwinding operation of a flexible draw means (not shown in the drawing).

To assist the brake arrangement 10 during the braking of an unwinding operation, an eddy-current brake 13 connected to the drum shaft 3 is provided on the other side of the brake arrangement 10 as viewed from the drum 2.

The drive unit 14 of the drawworks 100 for driving the drum 2 is arranged on the left-hand side of the drum 2 according to FIG. 1. In the exemplary embodiment shown, it comprises three electric drive motors 15, 16, 17, of which the two shown at the top are coupled to one another via a transmission unit 18.

On the output side, the drive motors 15, 16 on the one hand and 17 on the other hand are operatively connected to gearboxes 19, 20 which are coupled on the output side to a summation gear 21 which transmits the drive moment provided by the drive motors 15, 16, 17 to the drum shaft 3.

Figure 2:
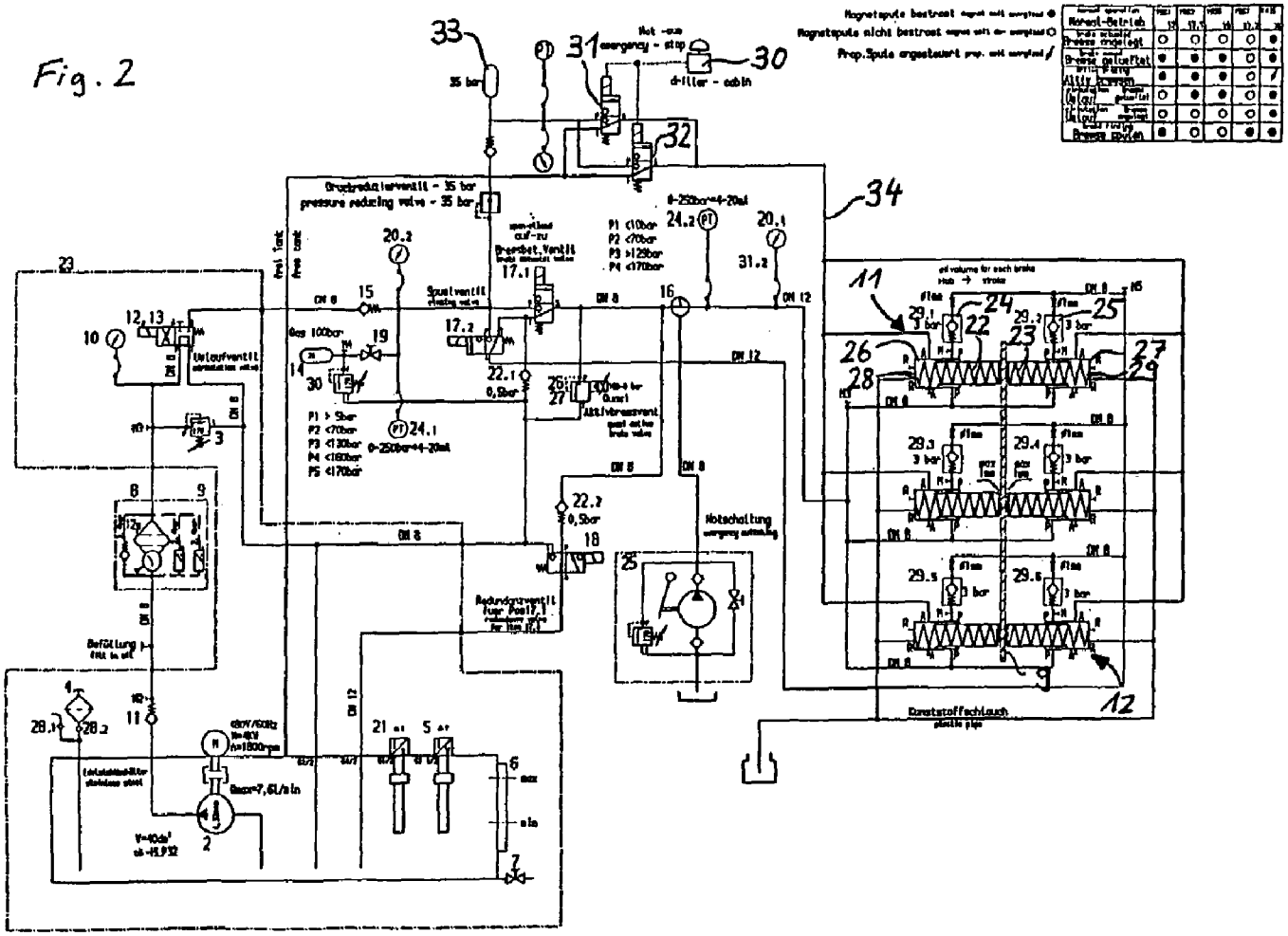
FIG. 2 shows a hydraulic plan which shows one possibility for the hydraulic design and activation of the embodiment according to FIG. 1.

In the drawworks 100, the brake caliper arrangements 11, 12 are configured in the manner which can be seen schematically from FIG. 2. They each comprises spring arrangements 22, 23 which press brake shoes (not shown in the drawing) against the brake disk 9. To reduce the braking force thus exerted on the brake shoes until the brake is completely released, hydraulically acting devices 24, 25 are provided which are designed in such a way that an admission of pressure leads to the contraction of the respectively associated spring arrangement 22, 23.

Furthermore, each spring arrangement comprises a further device 26, 27 which can be actuated hydraulically and with which the spring preloading can be increased, which, during actuation, leads to the increase in the braking force with which the respective brake shoe is pressed against the brake disk and thus leads to an increase in the braking power. To this end, in the exemplary embodiment shown in FIG. 2, the seat 28, 29 absorbing the reaction force of the respective spring arrangement 22, 23 is displaced toward the brake disk 9.

The emergency brake device formed by the measures described above is actuated by an emergency switch 30 which can be actuated manually and via which electromagnetically actuated hydraulic valves 31, 32 are activated, which upon actuation direct hydraulic fluid from a pressure reservoir 33 via lines 34 to the devices 26, 27.

The configuration described with reference to FIG. 2 of the brake caliper arrangement may be realized in one brake caliper arrangement or in a plurality of brake caliper arrangements of the brake arrangement.

Figure 3:
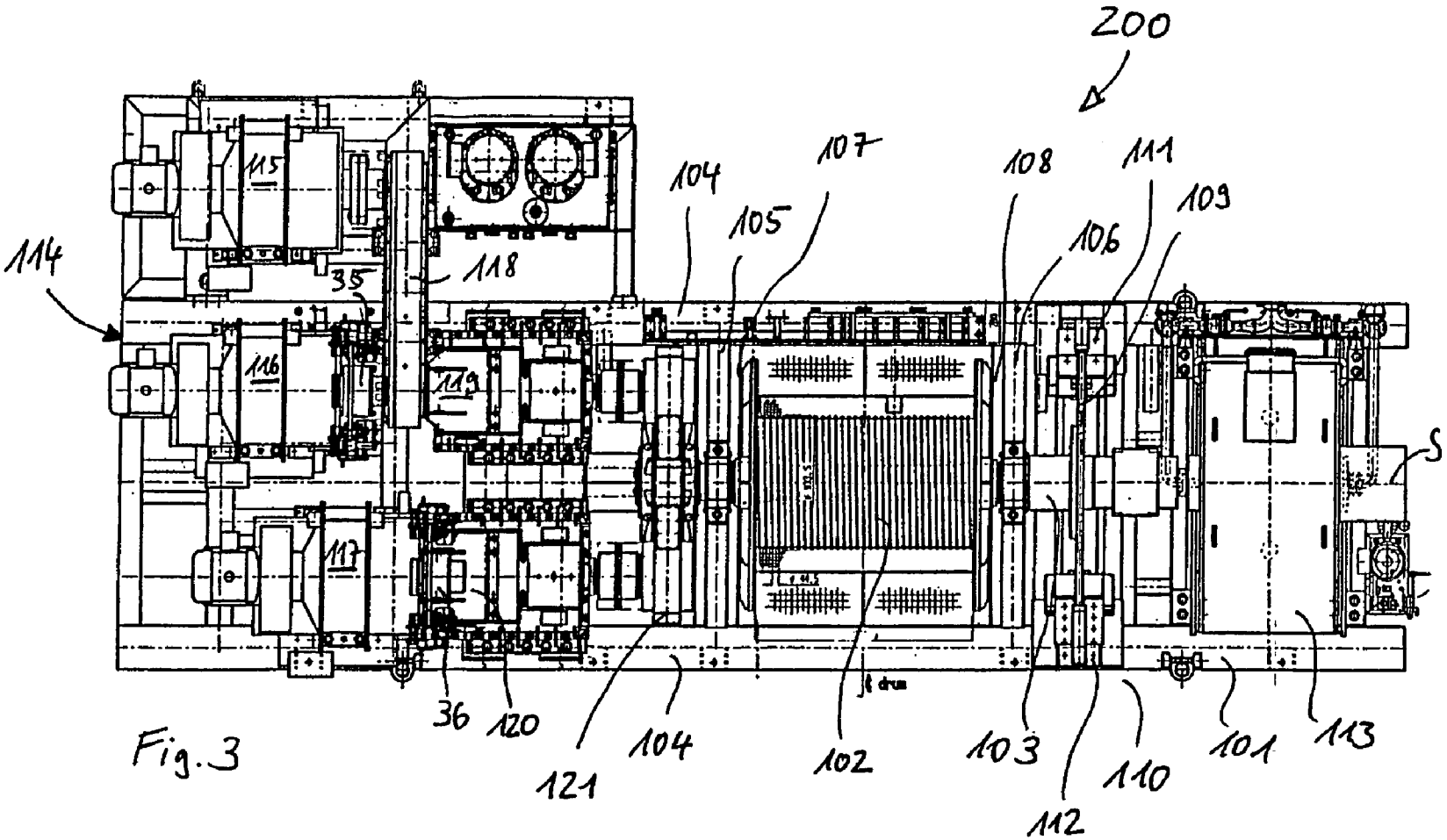
FIG. 3 shows a further embodiment of a drawworks according to the invention in an illustration corresponding to FIG. 1.

The further exemplary embodiment, shown in FIG. 3, of a drawworks according to the invention, which is designated overall by 200, corresponds in its construction and functioning in essential parts to the drawworks 100 according to FIG. 1. Accordingly, those components of the drawworks 200 which correspond to those of the drawworks 100 are provided with reference numerals increased by 100. In order to avoid repetitions, reference may be made in this respect to the above description. Only the differences between the drawworks 200 and the drawworks 100 are to be explained below.

In the drawworks 200, the shafts of the drive motors 116, 117 are connected to disk brake arrangements 35, 36, with which the respectively associated shaft can be braked. The disk brake arrangements 35, 36 together form an emergency brake device for producing an additional braking force.

Figure 4:
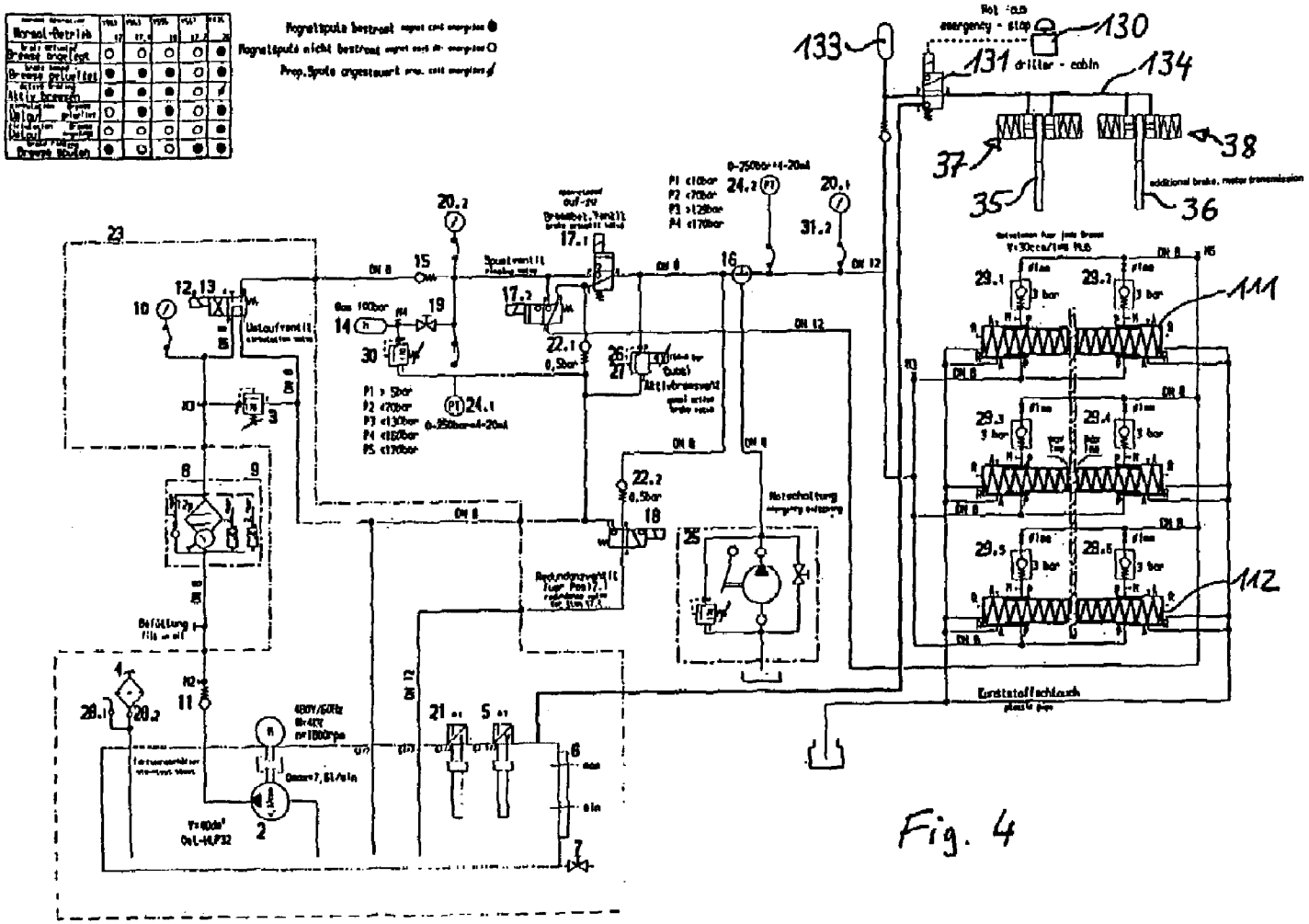
FIG. 4 shows a hydraulic plan which shows one possibility for the design and activation of the exemplary embodiment according to FIG. 3.

The disk brake arrangements 35, 36 are actuated in the manner which can be seen from FIG. 4 via an emergency switch 130 which can be actuated manually and via which an electromagnetically actuated hydraulic valve 131 is activated, which upon actuation draws off hydraulic fluid from the brake calipers 37, 38 via lines 134 to a tank. The brake caliper arrangements 37, 38 of the brake disk arrangements close elastically in a manner corresponding to the brake calipers 111, 112.

Figure 5:
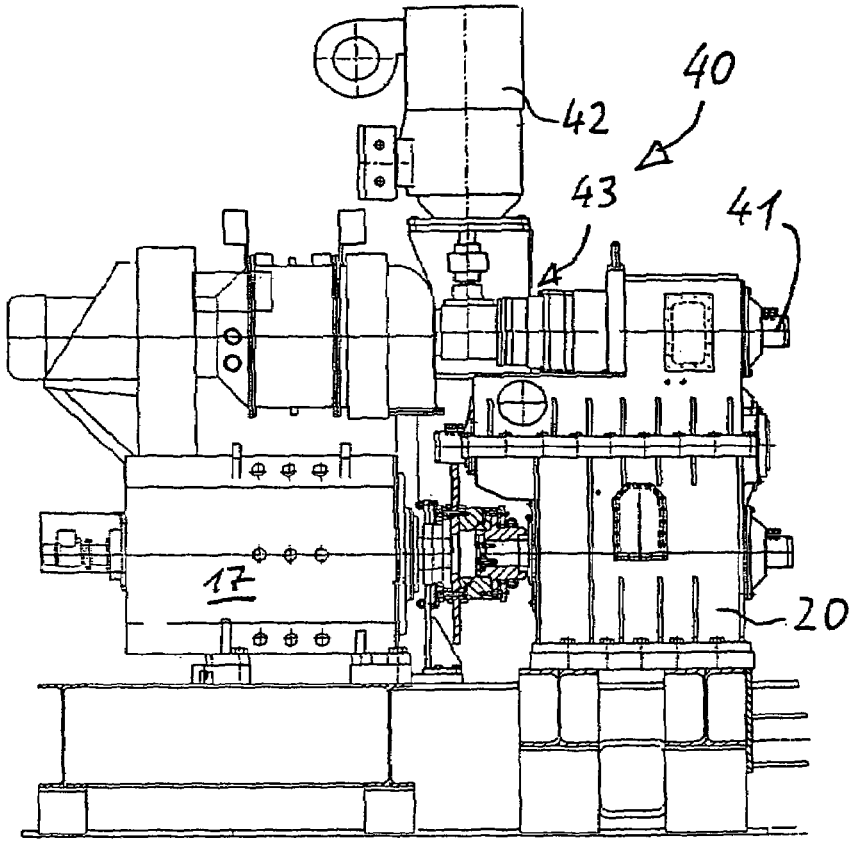
FIG. 5 shows a cutaway side view of the left-hand region according to FIGS. 1 and 3 of a further embodiment of a drawworks according to the invention.

In the further exemplary embodiment shown in a cutaway view in FIG. 5, the drawworks is equipped with a feeding device 40 which serves to slowly lower a load by means of the drawworks, for example a drilling device at feed rate. To this end, at least one of the gearboxes 19, 26, 119, 120 (by way of example reference is only to be made below to the gearbox 20) is provided with an additional input shaft 41 which can be coupled to the main gear shaft (not shown in the drawing). An additional drive motor 42 acts on the input shaft 41 via a miter gear 43. The entire feeding device 40 is dimensioned in such a way that the maximum permissible hoisting load for the drawworks can be applied by it. It may therefore be used as an emergency brake device for the case where the braking power of the brake arrangement of the drawworks diminishes and there is a risk of uncontrolled lowering of a load. To this end, the drive motor 42 is designed as an alternating-current motor which is operated via a frequency converter. To further increase the safety, two electric motors may also be provided instead of the one drive motor 42.

Figure 6:
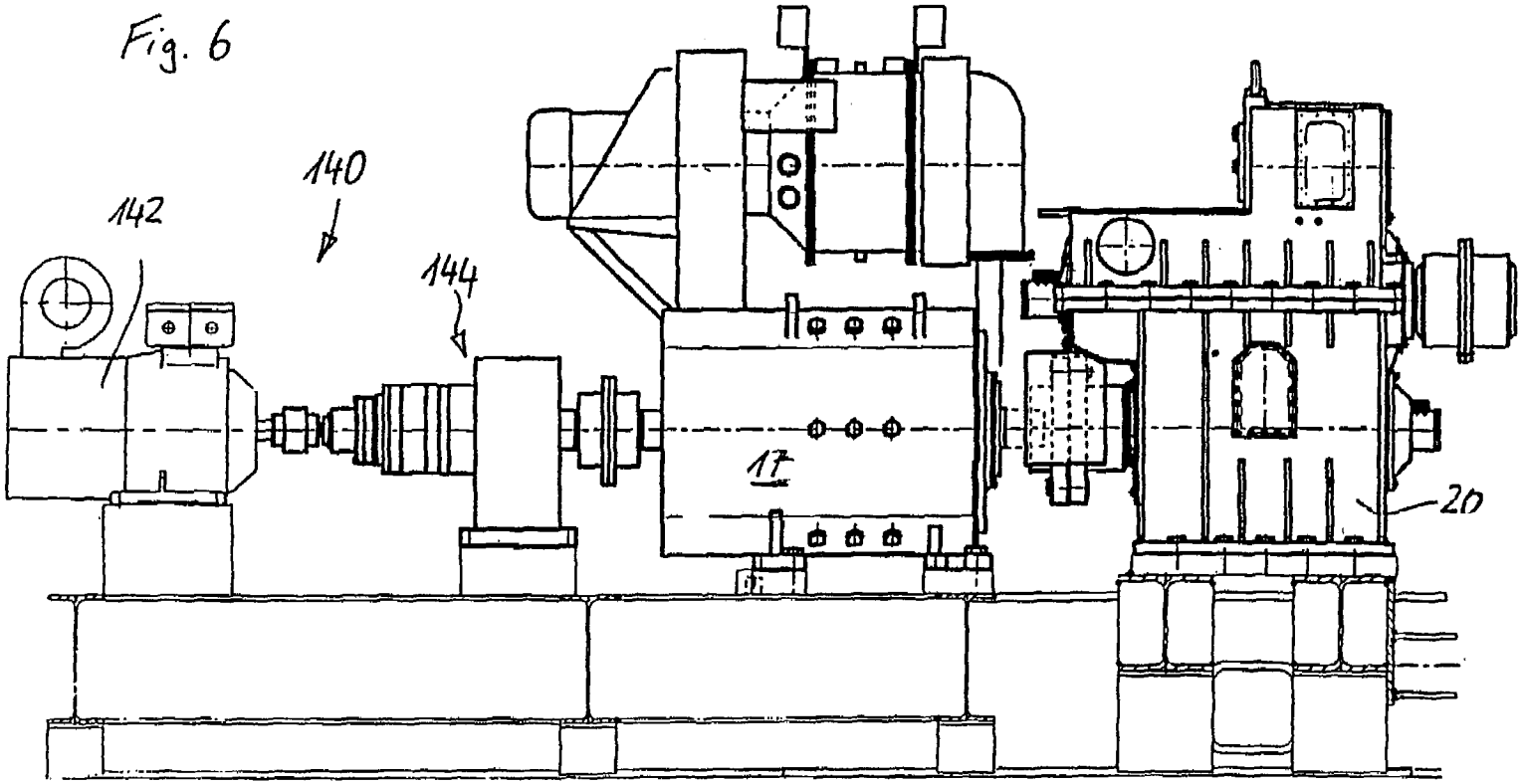
FIG. 6 shows a further embodiment of a drawworks according to the invention in a view corresponding to FIG. 5.

The exemplary embodiment of a drawworks shown in FIG. 6 in a cutaway view corresponds in its function to that according to FIG. 5. Here, however, the feeding device (designated overall here by 140) is not formed by a unit connected to the gearbox 20, but rather the drive motor 142 is connected via a coupling arrangement 144 to the shaft of the drive motor 17 on the side opposite the gearbox 20. The drive motor 142 may again be replaced by a plurality of motors.

List of Designations

1, 101 Frame
2, 102 Drum
3, 103 Drum shaft
4, 104 Longitudinal side
5, 105 Bearing block
6, 106 Bearing block
7, 107 End face
8, 108 End face
9, 109 Brake disk
10, 110 Brake arrangement
11, 111 Brake caliper arrangement
12, 112 Brake caliper arrangement
13, 113 Eddy-current brake
14, 114 Drive unit
15, 115 Drive motors
16, 116 Drive motors
17, 117 Drive motors
18, 118 Transmission unit
19, 119 Gearbox
20, 120 Gearbox
21, 121 Summation gear
22. Spring arrangement
23 Spring arrangement
24 Device
25 Device
26 Device
27 Device
28 Seat
29 Seat
30 Emergency switch
31 Valve
32 Valve
33 Pressure reservoir
34 Lines
35 Disk brake arrangement
36 Disk brake arrangement
37 Brake caliper arrangement
38 Brake caliper arrangement
40 Feeding device
41 Input shaft
42 Drive motor
43 Miter gear
100 Drawworks
S Axis
200 Drawworks
140 Feeding device
142 Drive motor
144 Coupling

The invention claimed is:

1. A drawworks for lowering and withdrawing a load, having at least one brake arrangement for braking and holding the load, and an emergency brake arrangement provided for producing an additional braking force, wherein the emergency brake arrangement comprises an additional brake device which can be engaged alternatively to the brake arrangement, wherein a control device is provided which compares a respective braking-power setpoint with a parameter characteristic of a braking-power actual value achieved by the brake arrangement and, in the event of a differential value of braking setpoint braking actual value>0, activates the emergency brake device so that the differential value corresponds approximately to 0, the maximum total braking power preferably being ≦130% of the braking power setpoint.

2. The drawworks as claimed in claim 1, wherein the brake arrangement has at least one brake shoe acting on a rotary part and a device for applying a braking force to the at least one brake shoe, the emergency brake arrangement being designed in such a way that an additional device for optionally exerting an additional braking force on the rotary part is provided.

3. The drawworks as claimed in claim 2, wherein the device for applying a braking force to the at least one brake shoe comprises a spring arrangement applying the braking force to the at least one brake shoe.

4. The drawworks as claimed in claim 3, wherein the device comprises an arrangement which acts in the opposite direction to the spring arrangement and is intended for controlling the braking force exerted on the brake shoe.

5. The drawworks as claimed in claim 4, wherein the additional device comprises an arrangement for displacing a seat absorbing the reaction forces of the spring arrangement.

6. The drawworks as claimed in claim 5, wherein the additional brake device is a hydraulically actuated device.

7. The drawworks as claimed in claim 1, wherein the brake arrangement and emergency brake arrangement are designed in such a way that in each case at least one hundred percent of the maximum braking power required can be achieved.

8. The drawworks as claimed in claim 1, wherein the construction of the emergency brake arrangement at least essentially the same as that of the brake arrangement.

9. The drawworks as claimed in claim 1, having at least one gearbox coupled on the input side to a drive motor and interacting on the output side with a summation gear, wherein the emergency brake arrangement is arranged on at least one of an input side and an output side of at least one of the gearbox and the summation gear.

10. The drawworks as claimed in claim 1, wherein the emergency braking arrangement is formed by a feeding device for the controlled or regulated lowering, holding or withdrawal of the load, this feeding device being suitably designed for braking and holding the maximum hoisting capacity of the drawworks.

11. The drawworks as claimed in claim 10, wherein the feeding device comprises an electrically, hydraulically or pneumatically driven motor.

12. The drawworks as claimed in claim 11, wherein the feeding device comprises a gearbox, to which the motor is coupled.

13. The drawworks as claimed in claim 12, wherein the motor can be coupled to the gearbox via an additional gear shaft.

14. The drawworks as claimed in claim 12, wherein the motor can be coupled to an input shaft of the gearbox for a main drive motor for the drawworks.

* * * * *